US007158130B2

(12) United States Patent
Lee et al.

(10) Patent No.: US 7,158,130 B2
(45) Date of Patent: Jan. 2, 2007

(54) METHOD AND APPARATUS FOR PREVENTING RESIDUAL IMAGE IN LIQUID CRYSTAL DISPLAY

(75) Inventors: Seok Woo Lee, Seoul (KR); Jin Kyoung Song, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 347 days.

(21) Appl. No.: 10/290,519

(22) Filed: Nov. 8, 2002

(65) Prior Publication Data

US 2003/0189564 A1 Oct. 9, 2003

(30) Foreign Application Priority Data

Apr. 8, 2002 (KR) ..... 2002-18893

(51) Int. Cl.
*G09G 5/00* (2006.01)

(52) U.S. Cl. ..... 345/211; 345/87; 345/10; 345/102; 345/204; 345/209; 345/214

(58) Field of Classification Search ..... 345/87–100, 345/102, 204–213, 690
See application file for complete search history.

(56) References Cited

U.S. PATENT DOCUMENTS 4,327,309 A * 4/1982 Wallot ..... 315/170
6,476,590 B1 * 11/2002 Chou ..... 323/284
6,621,489 B1 * 9/2003 Yanagisawa et al. ..... 345/211
6,961,034 B1 * 11/2005 Kusanagi ..... 345/87
2003/0080932 A1 * 5/2003 Konno et al. ..... 345/96
2003/0218587 A1 * 11/2003 Ikeda ..... 345/87

FOREIGN PATENT DOCUMENTS

JP 222134 8/1998
JP 249320 9/2001

* cited by examiner

*Primary Examiner*—Richard Hjerpe
*Assistant Examiner*—Leonid Shapiro
(74) *Attorney, Agent, or Firm*—McKenna Long & Aldridge LLP

(57) ABSTRACT

An adaptive method and apparatus prevents the formation of residual images in a liquid crystal display caused by a discharge of liquid crystal cells upon power-off. When an off-time of a ramp voltage is sensed, a white data signal may be generated. The white data signal is then displayed on a liquid crystal display panel until a power supply for the liquid crystal module is turned off.

18 Claims, 6 Drawing Sheets

METHOD AND APPARATUS FOR PREVENTING RESIDUAL IMAGE IN LIQUID CRYSTAL DISPLAY

This application claims the benefit of Korean Patent Application No. 2002-18893, filed on Apr. 8, 2002, which is hereby incorporated by reference for all purposes as if fully set forth herein.

BACKGROUND OF THE INVENTION

1. Field of the Invention

This invention relates to liquid crystal displays, and more particularly to an adaptive method and apparatus for preventing the formation of residual images in liquid crystal displays upon powering off.

2. Discussion of the Related Art

Generally, liquid crystal displays (LCDs) display pictures using electric fields to control the light transmittance of a liquid crystal. To this end, LCDs include a liquid crystal display panel for supporting a pixel matrix and a driving circuit for driving the liquid crystal display panel.

Referring to FIG. 1, LCDs generally include a liquid crystal module 10 for displaying a picture in response to video data signals inputted from a system part 2.

System part 2 includes a graphic card 4 for supplying signals (e.g., video data, etc.) suitable for driving the liquid crystal module 10, a system power supply 8 for supplying power, and a microcomputer 6 for controlling the system power supply 8.

The graphic card 4 converts inputted video data signals according to a resolution specific for a liquid crystal display panel 20, applies the converted video data signals to the liquid crystal module 10, and generates control signals (e.g., a main clock signal, a vertical synchronizing signal a horizontal synchronizing signal, etc.) specific to the resolution of the liquid crystal display panel 20.

The system power supply 8 supplies a driving voltage required to operate the graphic card 4 and the microcomputer 6. The supplied driving voltage is subsequently applied to a liquid crystal module (LCM) power supply 14 and inverter 24 included within the liquid crystal module 10.

The microcomputer 6 controls the system power supply 8 in accordance with a user command inputted through a power switch (not shown). The microcomputer 6 controls the amount of power applied to the LCM power supply 14 and a ramp power applied to the inverter 24 via the system power supply 8. For example, through the system power supply 8, the microcomputer 6 controls the time during which power is applied to the LCM power supply 14 and the time during which ramp power is applied to the inverter 24. Typically, the system power supply 8 is activated over the same time period during which the LCM power supply 14 is activated while the system power supply 8 is activated over a different time period during which the inverter 24 is activated. For example, inverter 24 is activated after the system power supply 8 is activated and is deactivated before the system power supply 8 is deactivated. Accordingly, an off-time of the inverter 24 occurs at an earlier point in time compared to the off-time of the system power supply 8.

The liquid crystal module 10 includes the liquid crystal display panel 20 for supporting liquid crystal cells, a data driver 16 for driving data lines D1 to Dm included in the liquid crystal display panel 20, a gate driver 18 for driving gate lines G0 to Gn included in the liquid crystal display panel 20, a timing controller 12 for controlling a driving time of the data and gate drivers 16 and 18, respectively, the LCM power supply 14 for generating driving voltages required for driving the liquid crystal display 10, a gamma circuit 22 for supplying gamma voltages to the data driver 16, a backlight unit 26 for providing light required to display pictures on the liquid crystal display panel 20, and an inverter 24 for supplying a driving voltage to the backlight unit 26.

The microcomputer 6 controls the system power supply 8 in accordance with a user command inputted through a power switch (not shown). The microcomputer 6 controls the amount of power applied to the LCM power supply 14 and a lamp power applied to the inverter 24 via the system power supply 8. For example, through the system power supply 8, the microcomputer 6 controls the time during which power is applied to the LCM power supply 14 and the time during which lamp power is applied to the inverter 24. Typically, the system power supply 8 is activated over the same time period during which the LCM power supply 14 is activated while the system power supply 8 is activated over a different time period during which the inverter 24 is activated. For example, inverter 24 is activated after the system power supply 8 is activated and is deactivated before the system power supply 8 is deactivated. Accordingly, an off-time of the inverter 24 occurs at an earlier point in time compared to the off-time of the system power supply 8.

The timing controller 12 accepts video data signals (e.g., R, G, and B) outputted from the graphic card 4 and applies the accepted video data signals to the data driver 16. Further, the timing controller 12 accepts a control signal outputted from the graphic card 4 and generates timing signals to control the timing of the data and gate drivers 16 and 18, respectively. Additionally, the timing controller 12 generates other control signals (e.g., polarity inversion signal, etc.).

The liquid crystal display panel 20 includes liquid crystal cells, arranged in a matrix pattern, connected to thin film transistors (TFTs). Each of the TFTs are provided at intersections of gate lines G1 to Gn and data lines D1 to Dm. The TFTs respond to gate signals applied from gate lines G1 to Gn and receive video signals applied from the data lines D1 to Dm. Each liquid crystal cell consists of a pixel electrode connected to an opposing common electrode via a liquid crystal and TFT. Accordingly, each liquid crystal cell may be equivalently expressed as a liquid crystal capacitor Clc. Such liquid crystal cells include a storage capacitor Cst connected to a pre-stage gate line in order to sustain data voltages charged within the liquid crystal capacitor Clc until subsequent data voltages are charged.

In response to a control signal outputted from the timing controller 12, the gate driver 18 sequentially applies a gate high voltage signal to gate lines G1 to Gn. The data driver 16 converts the video data signals outputted from the timing controller 12 into analog video voltage signals and applies analog video voltage signals, specific to one horizontal line, to data lines D1 to Dn for each horizontal period during which a gate high voltage signal is applied to the gate lines G1 to Gn. The gamma circuit 22 applies a predetermined gamma voltage to the data driver 16 in accordance with voltage levels associated with the analog video voltage signals. Thus, the data driver 16 uses gamma voltages supplied from the gamma circuit 22 to convert the video data signals outputted from the timing controller 12 into analog video voltage signals.

The inverter 24 converts a driving voltage inputted from the system power supply 8 into a high alternating current voltage corresponding to a lamp luminance of the backlight unit 26. The backlight unit 26 is provided at a rear side of the liquid crystal display panel 20 and supplies light suitable for displaying a picture. Accordingly, the backlight unit 26 includes lamp arranged within a lamp housing, a light guide for guiding light emitted from the lamp toward a surface of the liquid crystal panel, optical sheets attached to the light guide to enhance desirable lighting properties, and a reflector attached to a rear side of the light guide.

Referring to FIG. 2, a method for driving the liquid crystal display illustrated in FIG. 1 will now be described.

At time T1, if a 'power-on' command is inputted by a user, the microcomputer 6 turns the system power supply 8 on such that a driving voltage is applied to the LCM power supply 14. In turn, the LCM power supply 14 generates driving voltages (e.g., a base driving voltage Vcc, a gate high voltage Vgh, a gate low voltage Vgl, etc.) required to drive the liquid crystal module 10.

Simultaneously, at T1, if a reset signal (RESET) is generated from the microcomputer 6, the graphic card 4 generates video data signals at time T2 and applies the generated video data signals to the liquid crystal module 10. Using the driving voltages generated by the LCM power supply 14, the liquid crystal module 10 applies video data signals generated by the graphic card 4 to the liquid crystal display panel 20.

Subsequently, at time T3, the microcomputer 6 allows a lamp voltage (Vlamp) to be applied to the inverter 24 via the system power supply 6. As the lamp is activated by the lamp voltage (Vlamp) outputted by the inverter 24, the backlight unit 26 emits light into the liquid crystal display panel 20. Thus, the liquid crystal display panel 20 controls a transmittance of the light emitted from the backlight unit 26 in accordance with inputted video data signals, to display a picture.

A driving operation of the liquid crystal display panel 20 will now be described.

As the TFT is turned on by a gate high voltage Vgh applied to a gate line G, a video voltage signal, applied to the data lines D1 to Dm, is charged within the liquid crystal capacitor Clc. As the TFT is turned off by a gate low voltage Vgl applied to the gate line G, the video voltage signal remains charged within the liquid crystal capacitor Clc until the next data voltage signal is applied. Accordingly, the storage capacitor Cst connected to the liquid crystal capacitor Clc, in parallel, is charged with a data voltage signal when a gate high voltage Vgh is applied to a pre-stage gate line Gi-1. When a gate low voltage Vgl is applied, a higher voltage than the data voltage signal charged in the liquid crystal capacitor Clc is maintained during a turn-off interval of the thin film transistor. Thus, since the storage capacitor Cst applies electric charges to the liquid crystal capacitor Clc during a turn-off interval of the TFT, the variation in the voltage charged within the liquid crystal capacitor Clc is minimized.

At time T4, a power-off command is inputted from a user and the microcomputer 6 shuts off the lamp voltage applied to the inverter 24, via the system power supply 8. At time T5, the microcomputer 6 turns the system power supply 8 and the LCM power supply 14 off.

If the system power supply 8 is turned off, a problem occurs in that a video voltage charged within each liquid crystal cell of the liquid crystal display panel 20 slowly discharges through a leakage current of the TFT. This slow discharge causes residual images to be displayed by the liquid crystal display panel 20.

In order to eliminate residual images generated upon power-off, a separate discharge circuit may be provided to discharge voltages charged within each of the liquid crystal cells. For instance, a discharge circuit so provided may monitor a power-off event and apply a ground voltage to the gate lines to turn the TFTs on. Thus, the discharge circuit rapidly discharges voltages charged in each liquid crystal cell to eliminate residual images. However, as such discharge circuits must be provided at each gate line, the structure of the liquid crystal display panel becomes complex. Furthermore, when discharge circuits are applied to dot or line inversion liquid crystal modules, TFTs are turned on in liquid crystal cells having a negative voltage lower than the ground voltage applied to the gate electrode and thereby perform the compulsory discharge. On the other hand, TFTs are turned off in liquid crystal cells having positive voltage higher than the ground voltage and thereby do not perform the compulsory discharge. Accordingly, residual images still exist in dot or line inversion liquid crystal modules. Moreover, voltages charged in the liquid crystal cells employing the above discharge circuit are compulsorily discharged because are not sufficient to eliminate residual images because a certain discharge time exists.

SUMMARY OF THE INVENTION

Accordingly, the present invention is directed to a method and apparatus for preventing residual images in liquid crystal displays that substantially obviates one or more of the problems due to limitations and disadvantages of the related art.

Accordingly, an advantage of the present invention provides an adaptive method and apparatus for preventing residual images from forming in liquid crystal displays caused by the discharge of a liquid crystal cell upon power-off.

In order to achieve these and other advantages of the invention, a method of preventing the formation of residual images in liquid crystal displays, according to one aspect of the present invention, includes the steps of sensing an off-time of a lamp voltage to generate a white data signal and displaying the white data signal on a liquid crystal display panel until a power supply included within a liquid crystal module is turned off.

In one aspect of the present invention, the white data signal may be displayed on the liquid crystal display panel during at least one frame.

In another aspect of the present invention, a black data signal may be generated one frame prior to generation of the white data signal.

In yet another aspect of the present invention, an off-time of the lamp voltage may be sensed using a lamp voltage control signal applied from a microcomputer of a system driving the liquid crystal module to a system power supply when a power-off command is inputted from a user.

In still another aspect of the present invention, an off-time of the lamp voltage may be sensed using a lamp voltage outputted from the system power supply of the system driving the liquid crystal module when the power-off command is inputted from the user.

In accordance with the principles of the present invention, a residual image prevention apparatus for a liquid crystal display includes a liquid crystal module having a liquid crystal display panel for displaying a picture; a signal line driving circuit for driving signal lines of the liquid crystal display panel; a timing controller for controlling a driving time of the signal line driving circuit and for applying a data signal; a liquid crystal module power supply for supplying driving voltages required for driving the liquid crystal display panel; the signal line driving circuit, and the timing controller; a backlight unit for providing the liquid crystal display panel with light required to display the picture; a lamp driver for applying a lamp driving voltage to the backlight unit; and a system part for driving and controlling the liquid crystal module, wherein the timing controller may generate a white data signal when an off-time of the lamp voltage is applied to the lamp driver from the system part such that white data signal is displayed on the liquid crystal display panel.

In one aspect of the present invention, the residual image prevention apparatus, said system part may further include a system power supply for supplying a liquid crystal module voltage to a power supply of the liquid crystal module and supplying said lamp voltage to the lamp driver; a microcomputer for controlling the system power supply such that the power supply of the liquid crystal module and the lamp driver are activated during a different times; and a graphic card for applying the data signal and other control signals to the timing controller.

In another aspect of the present invention, the timing controller senses an off-time of the lamp voltage using a lamp voltage control signal applied from the microcomputer to the system power supply.

In yet another aspect of the present invention, the system part may further include a lamp voltage sensor for sensing an off-time of the lamp voltage to thereby generate a lamp voltage off signal; a white data signal generator for generating the white data signal in response to the lamp voltage off signal; a timing control signal generator for generating control signals controlling a driving time of a signal line driving integrated circuit using input control signals; and a data aligner for aligning and outputting an input data signal and the white data signal.

In still another aspect of the present invention, the timing controller may generate a black data signal for at least one frame prior to generating the white data signal when said off-time of the lamp voltage is sensed, thereby displaying the black data signal on the liquid crystal display panel.

The timing controller may allow the white data signal to be displayed on the liquid crystal display panel during at least one frame.

In another aspect of the present invention, the timing controller may generate the white data signal from the off-time of the lamp voltage until the power supply of the liquid crystal module is turned off, thereby displaying said white data signal on the liquid crystal display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Reference will now be made in detail to an embodiment of the present invention, example of which is illustrated in the accompanying drawings.

Figure 1:
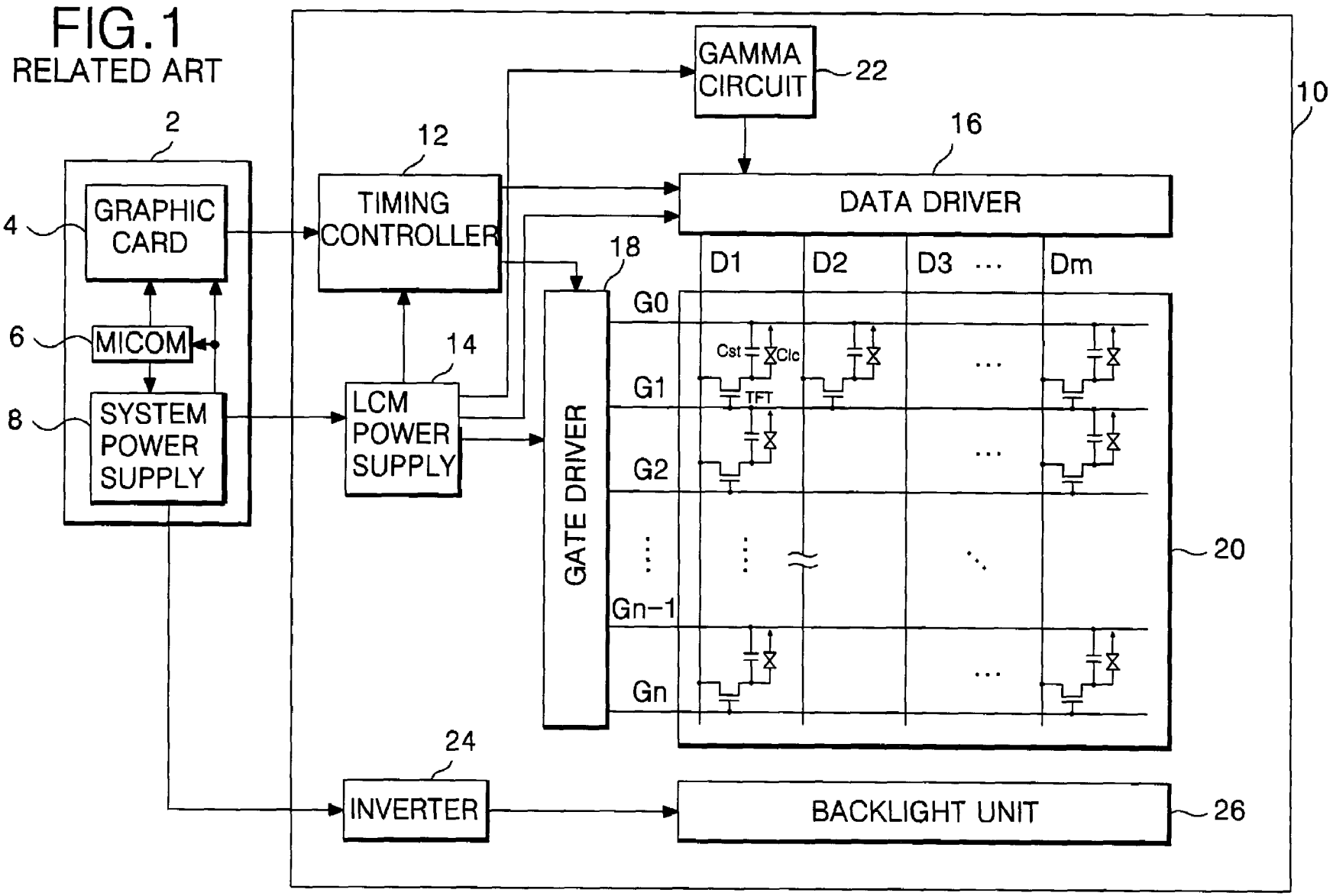
FIG. 1 RELATED ART
FIG. 1 illustrates a block diagram showing a configuration of a related liquid crystal display.
Figure 2:
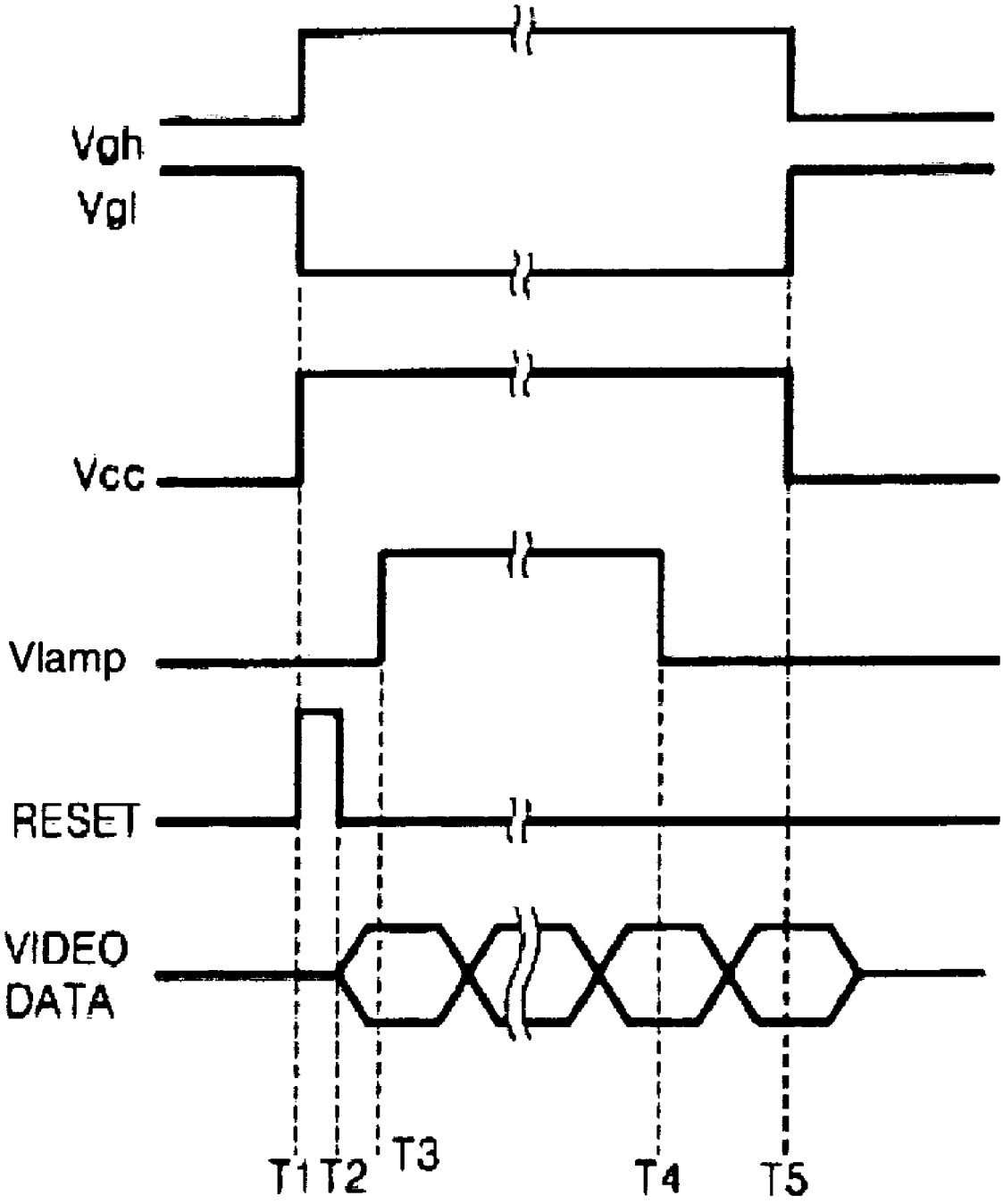
FIG. 2 RELATED ART
FIG. 2 illustrates a waveform diagram of an input voltage applied to each liquid crystal element of the liquid crystal display shown in FIG. 1.
Figure 3:
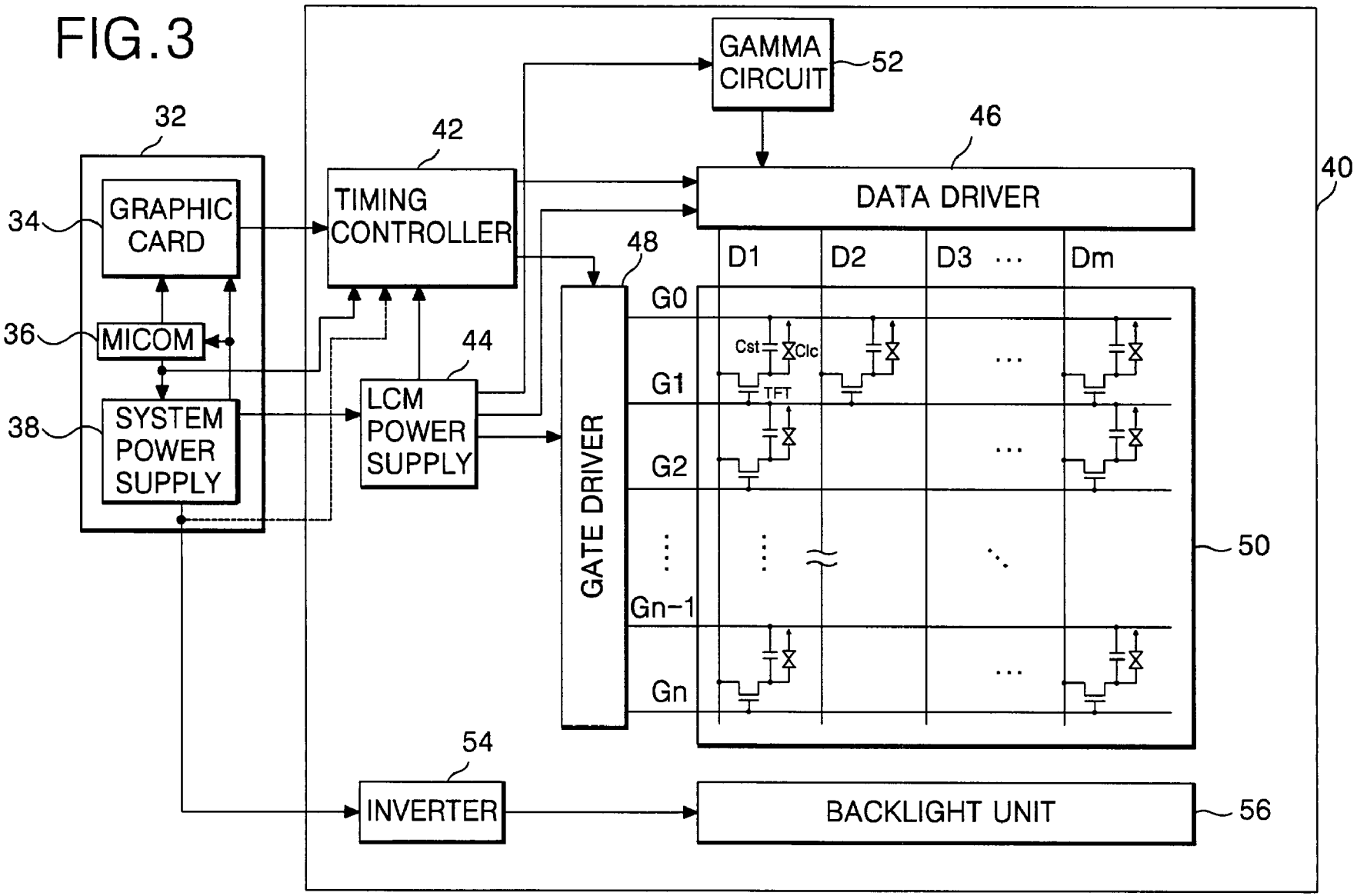
FIG. 3 illustrates a block diagram showing a configuration of a residual image prevention apparatus for a liquid crystal display according to an embodiment of the present invention.

FIG. 3 illustrates a block diagram showing a configuration of a residual image prevention apparatus for a liquid crystal display according to an embodiment of the present invention.

Referring to FIG. 3, the LCD according to the principles of the present invention may, for example, include a liquid crystal module 40 for displaying a picture in response to video data signals inputted from a system part 32.

System part 32 may, for example, include a graphic card 34 for supplying signals (e.g., video data, etc.) suitable for driving the liquid crystal module 40, a system power supply 38 for supplying power, and a microcomputer 36 for controlling the system power supply 38.

The graphic card 34 converts inputted video data signals according to a resolution specific for a liquid crystal display panel 50, applies the converted video data signals to the liquid crystal module 40, and generates control signals (e.g., a main clock signal, a vertical synchronizing signal, a horizontal synchronizing signal, etc.) specific to the resolution of the liquid crystal display panel 50.

The system power supply 38 supplies a driving voltage required to operate the graphic card 34 and the microcomputer 36. The supplied driving voltage is subsequently applied to a liquid crystal module (LCM) power supply 44 and inverter 54 included within the liquid crystal module 40.

The microcomputer 36 controls the system power supply 38 in accordance with a user command inputted through a power switch (not shown). The microcomputer 36 controls the amount of power applied to the LCM power supply 44 and a lamp voltage applied to the inverter 54 via the system power supply 38. For example, through the system power supply 38, microcomputer 36 controls the time during which power is applied to the LCM power supply 44 and the time during which lamp power is applied to the inverter 54. In one aspect of the present invention, the system power supply 38 is activated over the same time period during which the LCM power supply 44 is activated while the system power supply 38 is activated over a different time period during which the inverter 54 is activated. For example, inverter 54 may be activated after the system power supply 38 may be activated after the system power supply 8 is activated and may be deactivated before the system power supply 38 is deactivated. Accordingly, an off-time of the inverter 54 occurs at an earlier point in time compared to the off-time of the system power supply 38.

The liquid crystal module 40 may, for example, include the liquid crystal display panel 50 for supporting liquid crystal cells, a data driver 46 for driving data lines D1 to Dm included in the liquid crystal display panel 50, a gate driver 48 for driving gate lines G0 to Gn included in the liquid crystal display panel 50, a timing controller 42 for controlling a driving time of the data and gate drivers 46 and 48, respectively, the LCM power supply 44 for generating driving voltages required for driving the liquid crystal module 40, a gamma circuit 52 for supplying gamma voltages to the data driver 46, a backlight unit 56 for providing light required to display pictures on the liquid crystal display panel 50, and an inverter 54 for supplying a driving voltage to the backlight unit 56.

Using a voltage received from the system power supply 38, the LCM power supply 44 generates driving voltages (e.g., a base driving voltage Vcc, a gate high voltage Vgh, a gate low voltage Vgl, a gamma reference voltage, a common voltage, etc.) required to drive the liquid crystal module 40. Accordingly, the generated driving voltages may be applied to the timing controller 42, the data driver 46, the gate driver 48, and the gamma circuit 52.

The timing controller 42 accepts video data signals (e.g., R, G, and B) outputted from the graphic card 34 and applies the accepted video data signals to the data driver 46. Further, the timing controller 42 accepts a control signal outputted from the graphic card 34 and generates timing signals to control the timing of the data and gate drivers 46 and 48, respectively. Additionally, the timing controller generates other control signals (e.g., polarity inversion signal, etc.), as will be discussed in greater detail below.

Upon sensing an off-time of a lamp voltage, the timing controller 42 further generates a black data signal and/or a white data signal until the system power supply 38 is turned off such that the black and/or white data signal may be displayed on the liquid crystal display panel 50. Accordingly, residual images may be prevented from forming when the liquid crystal module 40 is powered-off. For example, the timing controller 42 may sense an off-time of the lamp voltage using either a lamp voltage control signal applied from the microcomputer 36 to the system power supply 38 or a lamp voltage applied from the system power supply 38 to the inverter 54.

The liquid crystal display panel 50 may, for example, include a plurality of liquid crystal cells arranged in a matrix pattern and connected to thin film transistors (TFTs). Each of the TFTs may be provided at intersections of gate lines G1 to Gn and data lines D1 to Dm. The TFTs respond to gate signals applied from the gate lines G1 to Gn and receive video signals applied from the data lines D1 to Dm. Each liquid crystal cell may include a pixel electrode connected to an opposing common electrode via a liquid crystal and TFT. Accordingly, each liquid crystal cell may be equivalently expressed as a liquid crystal capacitor Clc. Such liquid crystal cells may include a storage capacitor Cst connected to the pre-stage gate line in order to sustain data voltages charged within the liquid crystal capacitor Clc until subsequent data voltages are charged.

In response to a control signal outputted from the timing controller 42, the gate driver 48 sequentially applies a gate high voltage signal to gate lines G1 to Gn. The data driver 46 converts the video data signals outputted from the timing controller 42 into analog video voltage signals and applies analog video voltage signals, specific to one horizontal line, to data lines D1 to Dn for each horizontal period during which a gate high voltage signal is applied to the gate lines G1 to Gn. The gamma circuit 52 applies a predetermined gamma voltage to the data driver 46 in accordance with voltage levels associated with the analog video voltage signals. Thus, the data driver 46 uses gamma voltages supplied from the gamma circuit 52 to convert the video data signals outputted from the timing controller 12 into analog video voltage signals.

In one aspect of the present invention, the data driver 46 may convert the black and white data signals generated by the timing controller 42 into analog video voltage signals and apply them to the liquid crystal display panel 50.

The inverter 54 converts a driving voltage inputted from the system power supply 38 into a high alternating current voltage corresponding to a lamp luminance of the backlight unit 56. The backlight unit 56 may, for example, be provided at a rear side of the liquid crystal display panel 50 and supply light suitable for displaying a picture. Accordingly, the backlight unit 56 may include a lamp arranged within a lamp housing, a light guide for guiding light emitted from the lamp toward a surface of the liquid crystal panel, optical sheets arranged on the light guide to enhance light display properties, and a reflector arranged on a rear side of the light guide.

Figure 4:
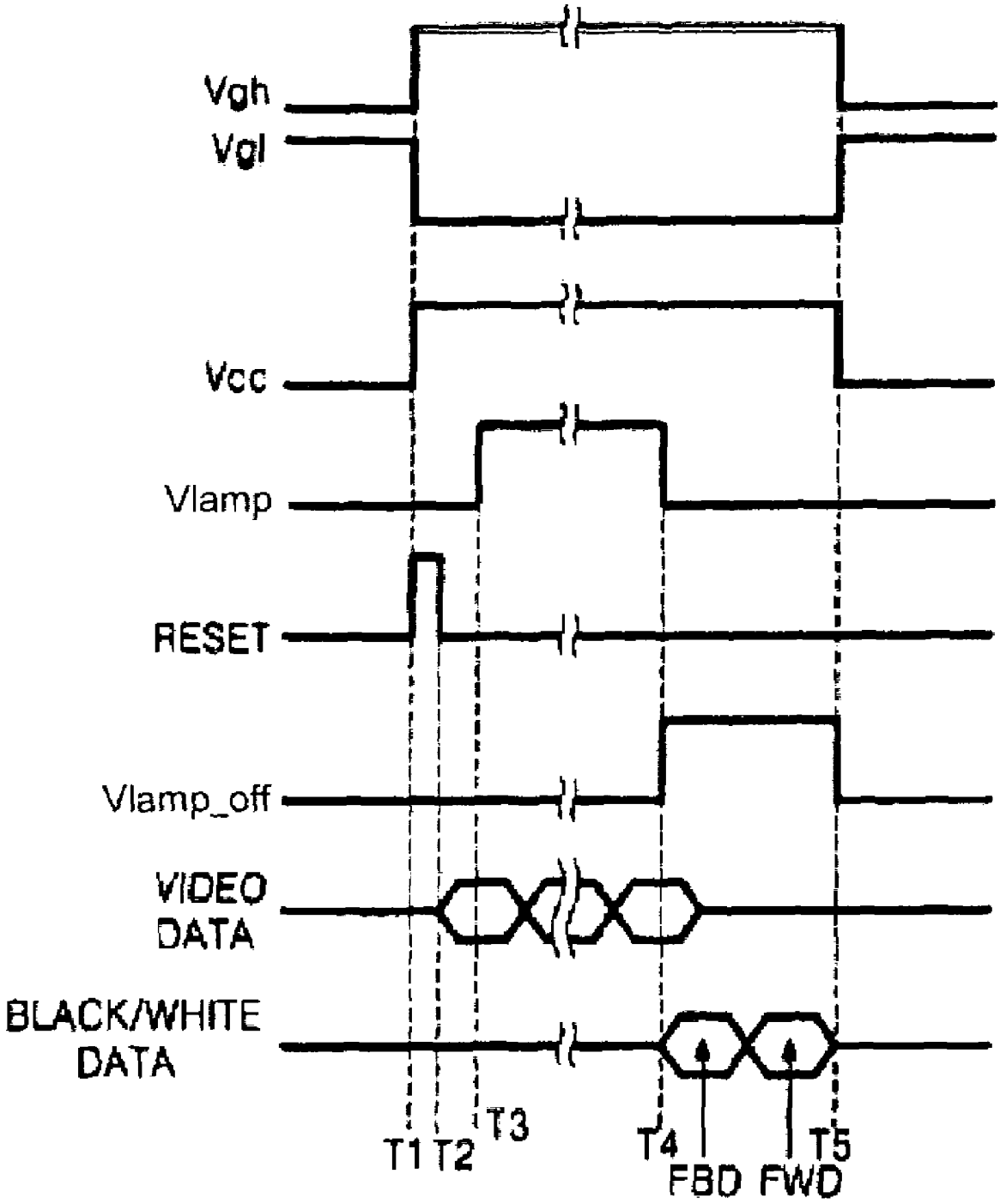
FIG. 4 illustrates a waveform diagram of an input voltage applied to each liquid crystal element of the liquid crystal display shown in FIG. 3.
Figure 5:
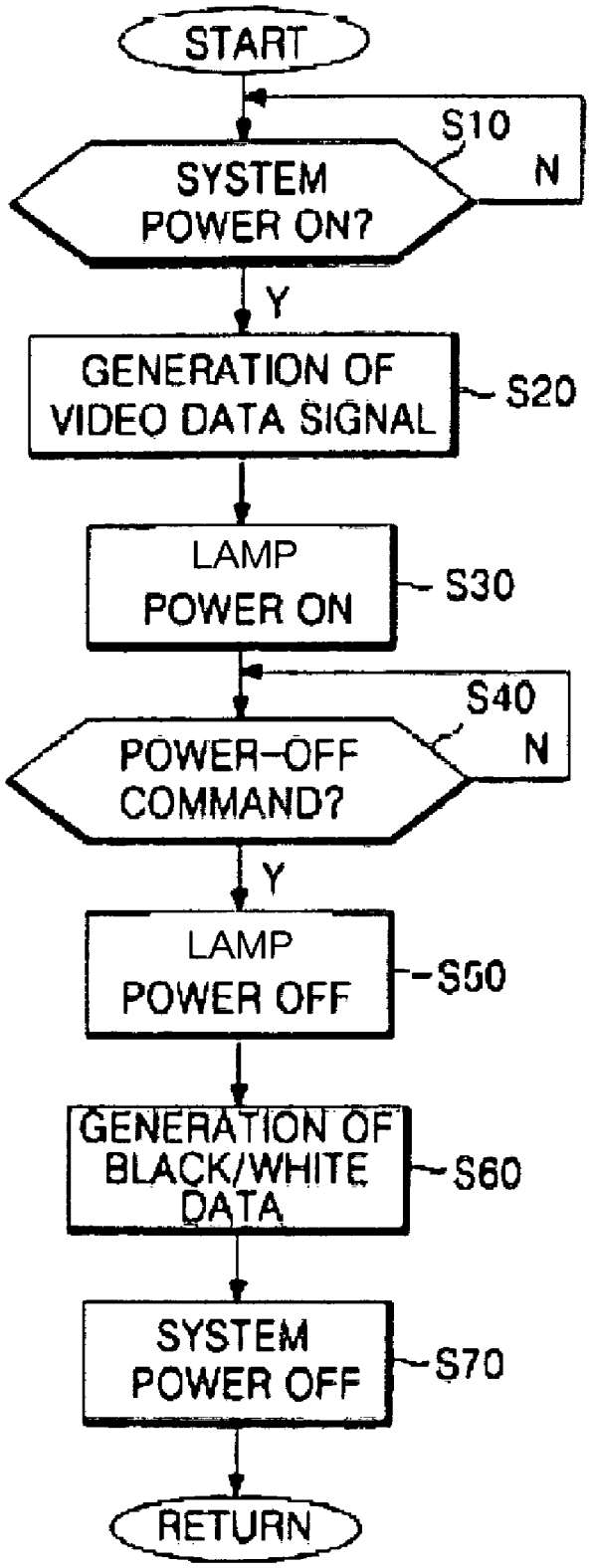
FIG. 5 illustrates a flow chart of a method for preventing a residual image in a liquid crystal display according to an embodiment of the present invention.

Referring to FIGS. 4 and 5, a method and driving procedure for driving the liquid crystal display illustrated in FIG. 3 will now be described.

At step S10 and time T1, if a 'power-on' command is inputted by a user, the microcomputer 36 turns the system power supply 38 on such that a driving voltage may be applied to the LCM power supply 44. In turn, the LCM power supply 44 generates driving voltages (e.g., a base driving voltage Vcc, a gate high voltage Vgh, a gate low voltage Vgl, etc.) required to drive the liquid crystal module 40.

At step S20, if a reset signal (RESET) is generated from the microcomputer 36, the graphic card 34 generates video data signals at time T2 and applies the generated video data signals to the liquid crystal module 40. Using the driving voltages generated by the LCM power supply 44, the liquid crystal module 40 applies video data signals generated by the graphic card 34 to the liquid crystal display panel 50.

At step S30 and time T3, the microcomputer 36 allows a lamp voltage (Vlamp) to be applied to the inverter 54 via the system power supply 36. As the lamp is activated by the lamp voltage (Vlamp) outputted by the inverter 54, the backlight unit 56 emits light into the liquid crystal display panel 50. Thus, the liquid crystal display panel 50 may control a transmittance of the light emitted from the backlight unit 56 in accordance with inputted video data signals, to display a picture.

A driving operation of the liquid crystal display panel 50 will now be described.

As the TFT is turned on by a gate high voltage Vgh applied to a gate line G, a video voltage signal, applied to the data lines D1 to Dm, may be charged within the liquid crystal capacitor Clc. As the TFT is turned off by a gate low voltage Vgl applied to the gate line G, the video voltage signal remains charged within the liquid crystal capacitor Clc until the next data voltage signal is applied. Accordingly, the storage capacitor Cst connected to the liquid crystal capacitor Clc, in parallel, is charged with a data voltage signal when a gate high voltage Vgh is applied to a pre-stage gate line Gi-1. When a gate low voltage Vgl is applied, a higher voltage than the data voltage signal charged in the liquid crystal capacitor Clc is maintained during a turn-off interval of the thin film transistor. Thus, since the storage capacitor Cst applies electric charges to the liquid crystal capacitor Clc during a turn-off interval of the TFT, the variation in the voltage charged within the liquid crystal capacitor Clc is minimized.

Next, at step S40 and time T4, a power-off command is inputted from a user and the microcomputer 36 shuts off the lamp voltage applied to the inverter 54, via the system power supply 38.

At step S50, the timing controller 42 may sense an off-time of the lamp voltage (Vlamp) and sequentially generate a full black data signal (FBD) and a full white data signal (FWD) such that the full black and white data signals may be displayed on the liquid crystal display panel 50. In another aspect of the present invention, the timing controller 42 senses an off-time of the lamp voltage (Vlamp) and may generate only a full white data signal (FWD) to be displayed on the liquid crystal display panel 50.

At step S60 and time T5, the microcomputer 36 turns the system power supply 38 and the LCM power supply 44 off.

As described above, a residual image prevention apparatus for the liquid crystal display, according to the present invention, senses an off-time of the lamp voltage (Vlamp). In one aspect of the present invention, after a user inputs a power-off command, the off-time of the lamp voltage (Vlamp) occurs earlier point in time compared to the off-time of the LCM power supply 44. Subsequently, either a black data signal and a white data signal, or only a white data signal may be displayed on the liquid crystal display panel 50 until the LCM power supply 44 is turned off. Accordingly, the formation of residual images may be prevented when the LCM power supply 44 is turned off.

Figure 6:
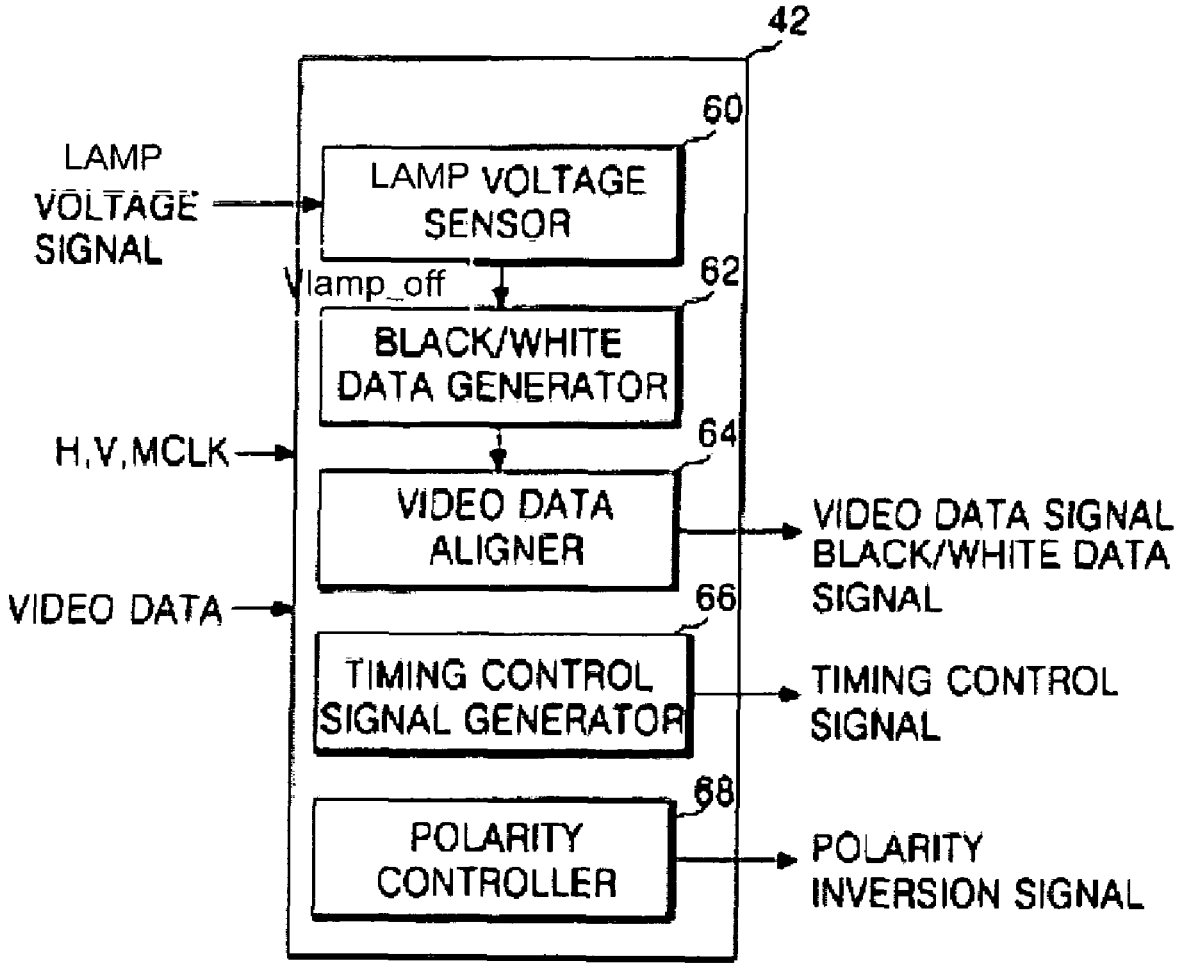
FIG. 6 illustrates a block diagram showing a detailed configuration of the timing controller shown in FIG. 3.

FIG. 6 illustrates a block diagram showing a detailed configuration of the timing controller 42 shown in FIG. 3.

Referring to FIG. 6, the timing controller 42 may, for example, include a timing control signal generator 66 for generating a timing control signal, a polarity controller 68 for generating a polarity inversion signal, a video data aligner 64 for aligning and outputting video data, a lamp voltage sensor 60 for sensing an off-time of the lamp voltage (Vlamp), and a black/white data signal generator 62 for generating and applying black and white data signals to the video data aligner 64 when a lamp voltage off signal (Vlamp off) is outputted from the lamp voltage sensor 60.

Using the control signals (e.g., a main clock signal, a vertical synchronizing signal, a horizontal synchronizing signal, etc.) generated by the graphic card 34, the timing control signal generator 66 generates timing control signals for the data driver 46 and the gate driver 48.

In response to the control signals outputted from the graphic card 34, the polarity controller 68 generates polarity inversion signals suitable for driving the liquid crystal display panel according to a predetermined inversion scheme (e.g., dot inversion, line inversion, frame inversion driving, etc.).

Using a lamp voltage control signal outputted from the microcomputer 36 and a lamp voltage signal (Vlamp) from the system power supply 38, the lamp voltage sensor 60 senses an off-time of the lamp voltage and generates a lamp voltage off signal (Vlamp off).

When a lamp voltage off signal (Vlamp off) is outputted from the lamp voltage sensor 60, the black/white data signal generator 62 sequentially generates a full black data signal (FBD) and a full white data signal (FWD) for one frame and applies the data signals to the video data aligner 64. In another aspect of the present invention, the black/white data signal generator 62 may be replaced by a white data signal generator, wherein the white data signal generator generates only a white data signal.

The video data aligner 64 receives video data outputted from the graphic card 34, realigns, and outputs the video data to drive the data driver 46. Further, when the lamp voltage is turned off, the video data aligner 64 re-aligns the full black data signal (FBD) and the full white data signal (FWD), outputted from the black/white data signal generator 62, and applies them to the data driver 46.

When an off-time of the lamp voltage is sensed, the timing controller 42 generates either a full black data signal (FBD) and a full white data signal (FWD) or only a full white data signal (FWD), applies the data signals to the data driver 46, and drives the data driver 46 and the gate driver 48. Accordingly, when a power-off command is inputted from a user, either a full black and full white signals, or only a full white signal, are displayed on the liquid crystal display panel, thereby preventing the formation of residual images when the liquid crystal module 40 is powered-off.

According to the principles of the present invention, when a power-off command is inputted from a user, an off-time of the lamp voltage is sensed. In one aspect of the invention, the off-time of the lamp voltage occurs earlier than an off-time of the LCM power supply 44. Accordingly, either a full black data signal (FBD) and a full white data signal (FED) or only a full white data signal (FWD) is displayed on the liquid crystal display panel until the LCM power supply 44 is turned off, thereby preventing the formation of residual images caused when the liquid crystal module 40 is powered-off.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of preventing the formation of residual images in a liquid crystal display having a system power supply, comprising:

providing a liquid crystal module, the liquid crystal module including a liquid crystal module power supply;

generating a white data signal when an off-time of a lamp voltage is sensed, wherein the lamp voltage is supplied by the system power supply; and applying the generated white data signal to a liquid crystal display panel until the liquid crystal module power supply is turned off, wherein the liquid crystal module power supply is turned off after the off-time of the lamp voltage is sensed.

2. The method according to claim 1, further comprising generating a black data signal one frame prior to generating the white data signal.

3. The method according to claim 1, wherein sensing the off-time of the lamp voltage comprises:

providing a microcomputer;

connecting the microcomputer to the system power supply;

inputting a power-off command; and outputting a lamp voltage control signal from the microcomputer to the system power supply in response to the inputted power-off command.

4. The method according to claim 1, wherein sensing the off-time of the lamp voltage comprises:

inputting a power-off command; and outputting a lamp voltage from the system power supply in response to the inputted power-off command.

5. The method according to claim 1, wherein the white data signal is applied to the liquid crystal display panel during at least one frame.

6. A residual image prevention apparatus for a liquid crystal display, comprising:

a liquid crystal module including a liquid crystal display panel for displaying a picture, the liquid crystal display panel including a plurality of signal lines;

a signal line driving circuit for driving the plurality of signal lines;

a timing controller for controlling a driving time of the signal line driving circuit and for applying a data signal;

a liquid crystal module power supply for supplying driving voltages suitable for the liquid crystal display panel, the signal line driving circuit, and the timing controller;

a backlight unit for providing light to the liquid crystal display panel;

a lamp driver for applying a lamp driving voltage to the backlight unit; and a system part for driving and controlling the liquid crystal module, wherein the system part includes a system power supply for supplying a liquid crystal module voltage to the liquid crystal module power supply and for supplying the lamp voltage to the lamp driver, wherein the timing controller is for generating a white data signal when an off-time of the lamp voltage, applied to the lamp driver from the system power supply, is sensed and for applying the white data signal, and wherein the liquid crystal module power supply is turned off after the off-time of the lamp voltage is sensed.

7. The residual image prevention apparatus according to claim 6, wherein the system part further includes:

a microcomputer for controlling the system power supply such that the power supply of the liquid crystal module and the lamp driver are activated during different times; and a graphic card for applying the data signal and a plurality of control signals to the timing controller.

8. The residual image prevention apparatus according to claim 7, wherein the timing controller is for sensing an off-time of the lamp voltage using a lamp voltage control signal applied from the microcomputer to the system power supply.

9. The residual image prevention apparatus according to claim 6, wherein the timing controller comprises:

a lamp voltage sensor for sensing an off-time of the lamp voltage and for generating a lamp voltage off signal;

a white data signal generator for generating the white data signal in response to the generated lamp voltage off signal;

a timing control signal generator for generating control signals for controlling a driving time of a signal line driving integrated circuit using input control signals; and a data aligner for aligning and outputting an input data signal and the white data signal.

10. The residual image prevention apparatus according to claim 6, wherein the timing controller is for generating a black data signal during at least one frame prior to generating the white data signal when the off-time of the lamp voltage is sensed, thereby applying the black data signal to the liquid crystal display panel.

11. The residual image prevention apparatus according to claim 6, wherein the timing controller is for applying the white data signal to the liquid crystal display panel during at least one frame.

12. The residual image prevention apparatus according to claim 6, wherein the timing controller is for generating the white data signal based on the off-time of the lamp voltage until the power supply of the liquid crystal module is turned off, thereby displaying white data signal on the liquid crystal display panel.

13. A liquid crystal display, comprising:

a liquid crystal display panel;

a backlight unit;

an inverter for applying a lamp driving voltage to the backlight unit;

a timing controller for applying a data signal to the liquid crystal display panel; and a liquid crystal module power supply for supplying driving voltages suitable for the liquid crystal display panel and the timing controller, wherein when the lamp driving voltage is not applied, the timing controller generates a white data signal displayable on the liquid crystal display panel, wherein the timing controller includes a lamp voltage sensor for sensing when the lamp driving voltage is not applied, and wherein the liquid crystal module power supply is turned off after an off-time of the lamp voltage is sensed.

14. The liquid crystal display according to claim 13, wherein the timing controller further includes:

a white data signal generator for generating the white data signal; and a data aligner for aligning and outputting an input data signal and the white data signal.

15. The liquid crystal display according to claim 13, wherein the white data signal is displayable for at least one frame.

16. The liquid crystal display according to claim 13, wherein when the lamp driving voltage is not applied, the timing controller generates a black data signal displayable on the liquid crystal display panel.

17. The liquid crystal display according to claim 16, wherein the black data signal is displayable for at least one frame prior to the white data signal being displayable.

18. The liquid crystal display according to claim 13, further comprising:

a liquid crystal module power supply for generating driving voltages required for driving the liquid crystal display, wherein the white data signal is displayable until the liquid crystal module power supply is turned off.

* * * * *